US006736735B2

(12) United States Patent
Galanis et al.

(10) Patent No.: US 6,736,735 B2
(45) Date of Patent: May 18, 2004

(54) SPORTS SWING TRAINING APPARATUS

(76) Inventors: Michael J. Galanis, 133 Concord Cir., Valpraiso, IN (US) 46385; Dale Kempf, 1953 Woodridge Cir., Valpraiso, IN (US) 46383; William C. Hughes, 910 Hobe Rd., Woodstock, IL (US) 60098

( * ) Notice: Subject to any disclaimer, the term of this patent is extended or adjusted under 35 U.S.C. 154(b) by 0 days.

(21) Appl. No.: 09/997,728

(22) Filed: Nov. 30, 2001

(65) Prior Publication Data

US 2003/0104874 A1 Jun. 5, 2003

(51) Int. Cl.[7] ..... A63B 57/00
(52) U.S. Cl. ..... 473/221
(58) Field of Search ..... 473/220, 221, 473/222, 219, 234

(56) References Cited

U.S. PATENT DOCUMENTS

| | | | | | |
|---|---|---|---|---|---|
| 4,321,592 | A | * | 3/1982 | Crandall et al. | 340/541 |
| 5,374,063 | A | * | 12/1994 | Ogden | 473/220 |
| 5,441,269 | A | | 8/1995 | Henwood | |
| 5,792,001 | A | * | 8/1998 | Henwood | 473/224 |
| 6,461,248 | B1 | * | 10/2002 | Gross | 473/220 |

FOREIGN PATENT DOCUMENTS

| | | |
|---|---|---|
| JP | 56-31766 | 3/1981 |
| JP | 60-135074 | 7/1985 |
| JP | 2-63882 | 5/1990 |
| JP | 4-103179 | 9/1992 |

* cited by examiner

*Primary Examiner*—Kim Nguyen
(74) *Attorney, Agent, or Firm*—Michael Best & Friedrich LLP

(57) ABSTRACT

The present invention concerns a club for impacting an object. The club may have a club head having a club face. At least one microprocessor in communication with a plurality of infrared sources is also provided. There are also a plurality of infrared sensors, and indicators configurable in a configuration indicating proper club face alignment and a configuration indicating club face misalignment. The infrared sources are periodically pulsed by a microprocessor between an activated and deactivated state. The sensors are configured on the club head to receive infrared from the infrared sources and to generate a signal in response to the infrared received. The microprocessor is programmed to receive signals from the sensors when the infrared sources are activated. The microprocessor is programmed to activate the indicators in an aligned or misaligned configuration.

13 Claims, 4 Drawing Sheets

SPORTS SWING TRAINING APPARATUS

BACKGROUND OF THE INVENTION

The present invention relates to a sports swing training apparatus. More specifically, the present invention relates to a training device that assists a user in attaining the proper alignment of a piece of sports equipment with an object to be struck during a user's swing.

SUMMARY OF THE INVENTION

In prior attempts such as that set forth in U.S. Pat. No. 5,374,063, the disclosure of which is specifically incorporated herein by reference, a training golf club is disclosed. The device uses discreet components in conjunction with infrared sensors, among other things, to provide a user with feedback in the form of LED indicators to promote the proper club face alignment. This is accomplished by reflecting infrared beams off of a golf ball back to sensors.

There are several drawbacks associated with the design disclosed. First, after the ball is struck, the target golf ball quickly speeds away. This results in the LED indicators turning off since the golf ball is needed to reflect infrared back to the sensors. This, in turn, prevents the golfer from receiving information as to the alignment of the club face with respect to the ball at the time of impact since, again, the impact of the club with the ball results in the termination of the indicator lights. This problem is especially present where swing speeds can be around 70–100 mph for clubs other than putters and where the duration of the swing may last for several seconds.

In addition, the infrared technology of the prior art training aid cannot be used in outdoor applications. This is the result of the infrared generated by the sun interfering with the device's ability to operate.

The present invention overcomes the deficiencies noted above. The problem with losing the alignment information upon impact is solved by freezing the alignment information at the moment of impact for later use by the user. The second problem of not being able to use the device outside is solved by the use of a circuit which ignores the infrared generated by the sun and which selectively focuses on the infrared beams generated by the device.

DESCRIPTION OF THE DRAWINGS

These and other features, objects and advantages of the present invention will become apparent from the following description and drawings wherein like reference numerals represent like elements in several views, and in which.

DESCRIPTION OF THE PREFERRED EMBODIMENT

Figure 1:
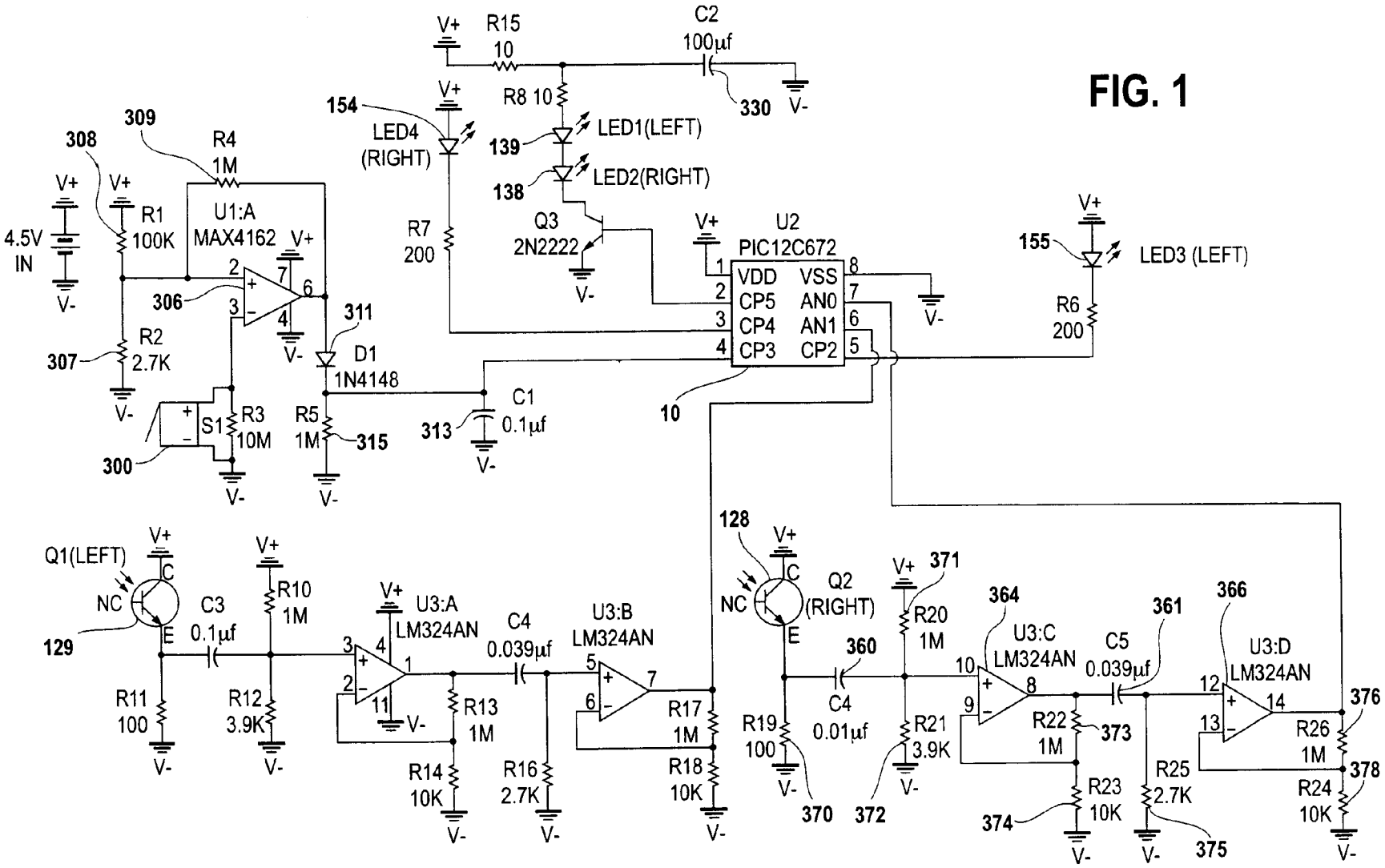
FIG. 1 is a schematic diagram of the circuitry used with the present invention.

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

The present invention comprises a swing training aid 110 which may be a putter, driver, iron, wood type of club or some other device that has a club head 116 such as a tennis racket, baseball bat, hockey stick, and other types of equipment. However, for ease of reference, the embodiment concerning a golf club will be primarily referred to in this specification. A shaft 14 may also be provided. The club has a face or surface 140 that impacts an object such as ball 22. The circuitry used to operate the device's electronics may be housed in a cavity of club 116, elsewhere in the club such as handle 14, or in a combination of places.

FIG. 1 shows the circuitry used with the present invention. At the center of the circuitry is microprocessor 10 which is in communication with a number of circuits.

Figure 4:
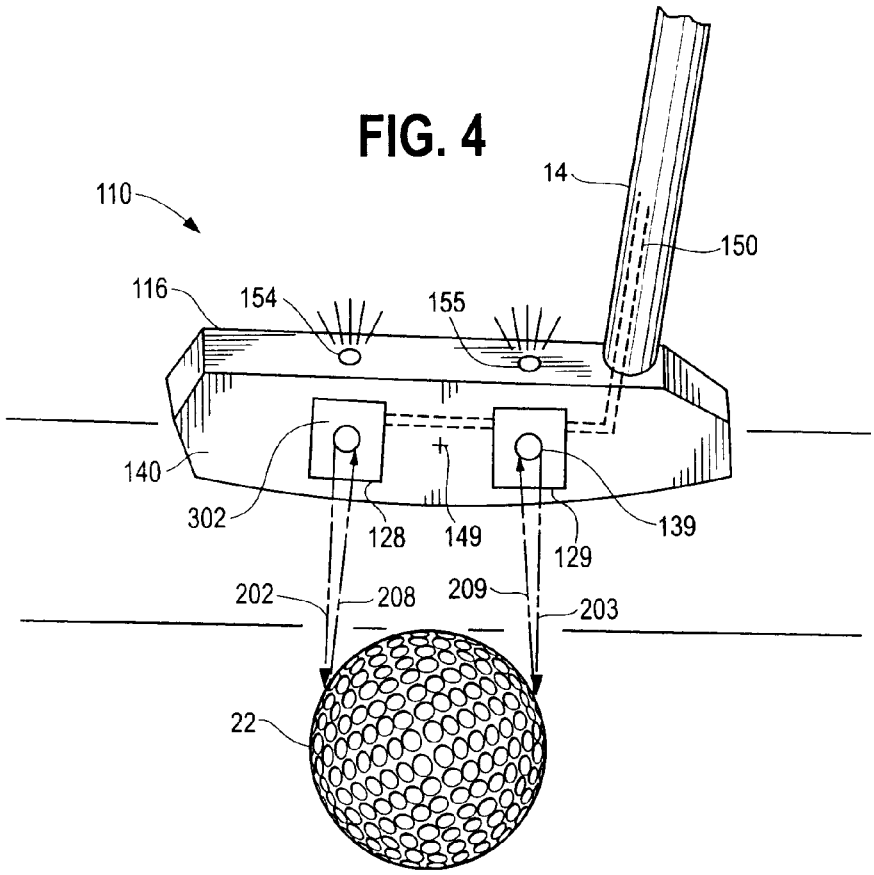
FIG. 4 is a schematic illustration of a preferred embodiment of the invention wherein the training device is a golf club head which is in a preferred alignment with a golf ball.
Figure 5:
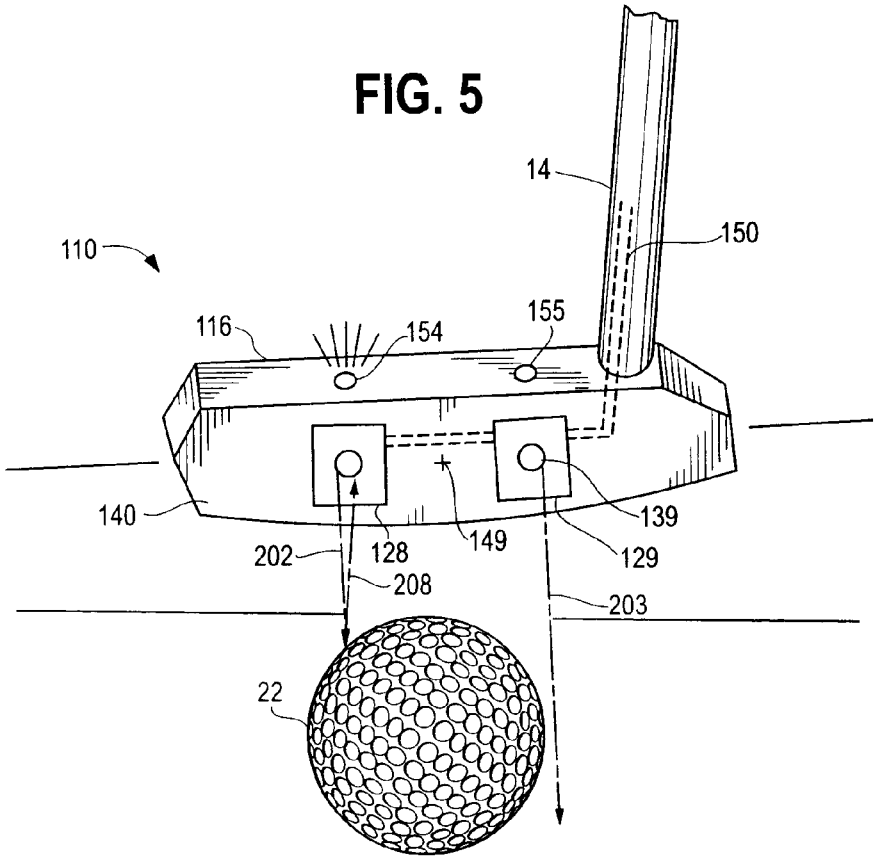
FIG. 5 is a schematic illustration of the preferred embodiment of the present invention wherein the golf club head is misaligned with a golf ball.
Figure 6:
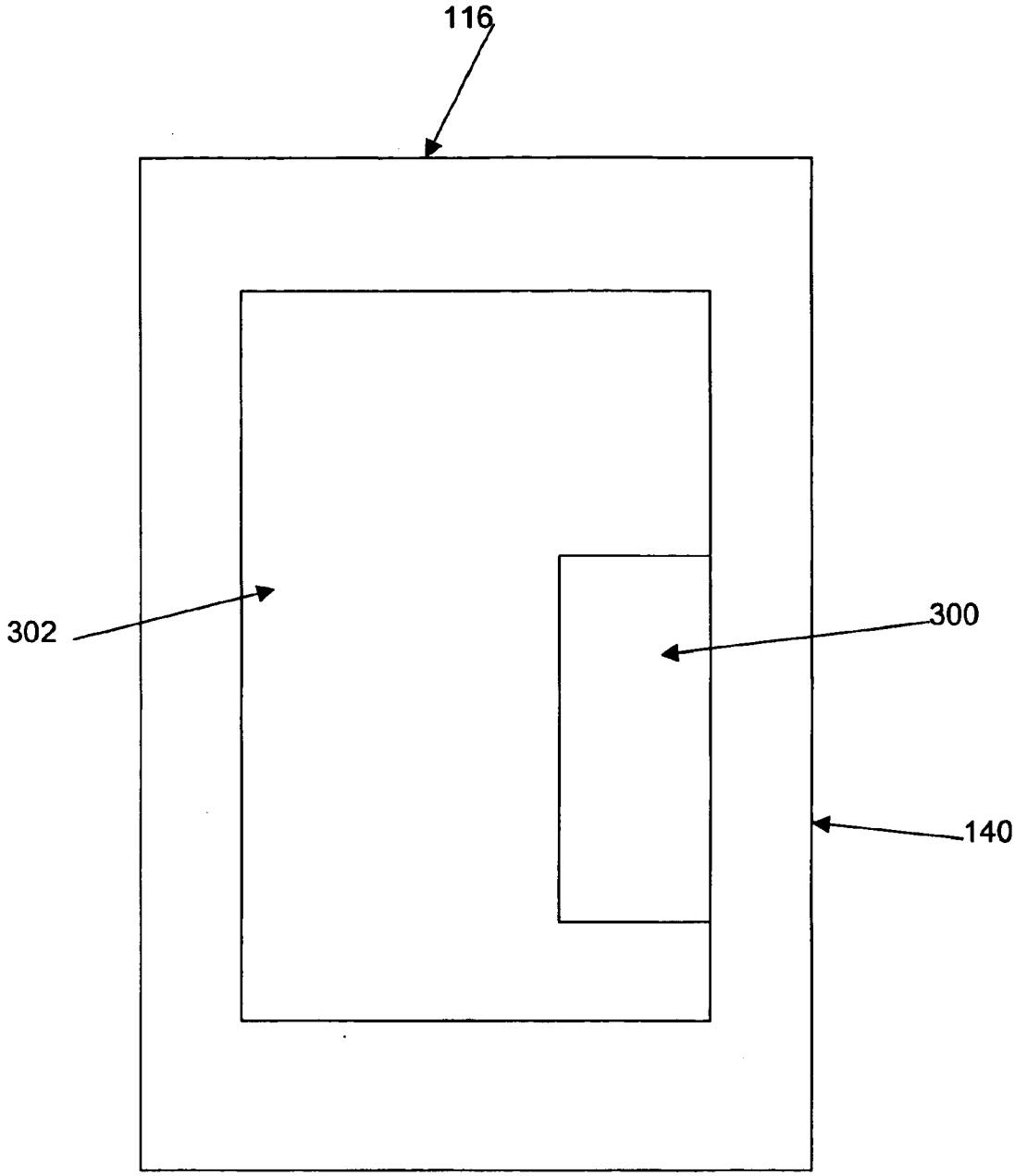
FIG. 6 is a partial cross-sectional view with portions removed to illustrate a club having an impact surface and a cavity in which a sounder is located.

One circuit is designed to freeze the indicator LEDs 154 and 155 in either an aligned signal or configuration as well as a misaligned signal or configuration as shown in FIGS. 4 and 5.

FIG. 4 indicates that the golf ball 22 has been squarely struck since both indicators 154 and 155 are illuminated. FIG. 5 shows a misaligned hit. Only indicator 154 is illuminated which indicates a toe-in alignment or that the club face 140 was closed at impact. If indicator 155 was only illuminated, it would indicate that the club face was open at impact.

The circuit includes a piezo sounder 300 located in golf club head 116 in cavity 302. When surface 140 of the golf club head 116 strikes a golf ball, the impact causes the sounder 300 to generate a voltage which is directed through op/amp 306 to create a digital signal that is fed to the microprocessor 10. Once the microprocessor receives the signal it freezes the information it is currently receiving from the other components of the invention as to the position of the club face with respect to the golf ball. This information is frozen for a predetermined period of time. In one preferred embodiment the amount of time is between 2–6 seconds with 4 seconds being the most preferred.

As shown in FIG. 1, the voltage or signal generated from sounder 300 may be directly fed to the microprocessor. However, it has been found that a base voltage may also be applied to one line of the op/amp via resistors 307 and 308, with the feedback connected to the op/amp via resistor 309. In this embodiment, once the sounder 300 creates a voltage upon impact, op/amp 306 amplifies the signal which is fed through diode 311 to microprocessor 10. Capacitor 313 also charges and then discharges through resistor 315, so that a continuous signal of predetermined length is provided to the microprocessor. This is done as a result of finding that, in some instances, the signal generated by the impact may occur too quickly for detection by the microprocessor.

Figure 3:
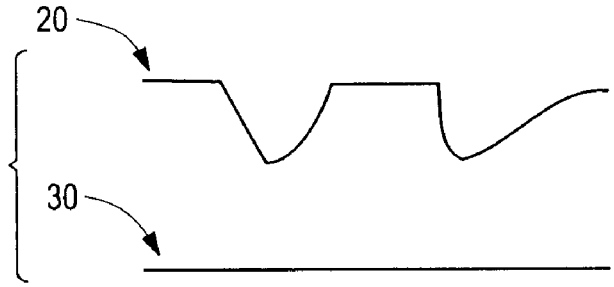
FIG. 3 is a graphical representation of the voltage applied to the infrared LEDs.

Another circuit used with the present invention concerns supplying power to the LEDs 138 and 139 in a more efficient manner and in a manner which allows for operation in an outdoor environment. It has been found that to increase the device's ability to work outdoors the LEDs need to be turned on as bright as possible. This, however, leads to power supply problems, in that, as shown in FIG. 3, line 20, the power supplied to the LEDs tends to diminish over time, especially, as will be explained in further detail below, when the LEDs are pulsed at a predetermined rate, with 4 kilohertz being preferred.

To overcome this situation, a capacitor 330 is provided which supplies power to the LEDs as well. The LEDs are turned on and off (pulsed), through the use of transistor switch 332 which is operated by the microprocessor 10. When the LEDs are in an activated state, capacitor 330 supplies power to the LEDs 138 and 139. When the LEDs are in a deactivated state, again through the use of switch 332, capacitor 330 is charged. Using the capacitor in this manner provides a constant power supply to the LEDs as shown by line 30 in FIG. 3.

Another circuit used with the present invention aids in the operation of the device in the outdoors where sunlight is present. Sunlight is a problem because its infrared washes out the infrared generated by LEDs 138 and 139 and disrupts the ability of sensors 128 and 129 to receive valid infrared signals from LEDs 138 and 139.

Two identical circuits are provided to solve this problem. Since each circuit is the same, reference will be made to the circuit used with sensor 128, with the same design applying to the circuit associated with sensor 129. Once sensor 128 receives infrared from LED 138, it sends a signal through capacitor 360. A capacitor is used because it permits an alternating current signal to pass while blocking out a direct current signal. Since sunlight is, in essence, detected as a direct current signal, the reception of this infrared by the sensor is not mistakenly received by the microprocessor as a false reading. It is filtered out by capacitor 360. The capacitor's ability to separate these two types of currents or signals is also why LEDs 138 and 139 are pulsed at 4 kilohertz so as to create an AC current or signal that will pass through capacitor 360 for detection by microprocessor 10. It has been found through trial and error that a pulse rate of about 2–6 kilohertz is acceptable with a pulse rate of 4 kilohertz being most preferred.

Once the signal is passed through capacitor 360 a two stage amplifier consisting of op/amps 364 and 366 is used. Associated with the op/amps are resistors 370–378 which form part of the two stage amplifier. It has also been found that placing a second capacitor 361 between the op/amps, which functions in the same manner as capacitor 360, is also beneficial to the operation of the device in the presence of natural sunlight.

Figure 2:
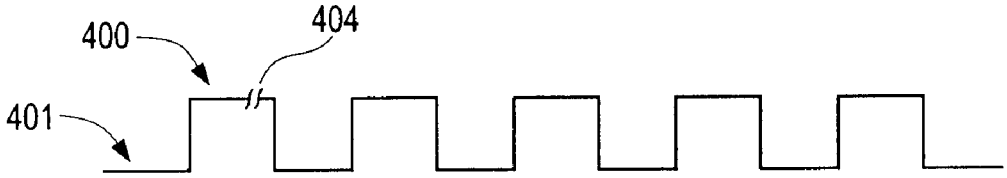
FIG. 2 is a representation of a pulsed signal generated by the present invention for use with the infrared LEDs.

Another way in which the apparatus reduces the effects of sunlight on the device's ability is to program the microprocessor to accept input from sensors 128 and 129 during time periods when LEDs 138 and 139 are activated and to ignore signals received during time periods when the LEDs are deactivated. In another embodiment, not only does the microprocessor only sense a signal from the sensors during activation, it also does so during a specific time period in the cycle. As shown in FIG. 2, it is desirable for the microprocessor to be programmed to look for a signal during the later half of the activation cycle 400, with the deactivation cycle being designated 401. Programming microprocessor 10 to look for a signal at about point 404 in the cycle further takes into account a finding that the sun causes a phase-shift in the 4 kilohertz AC cycle. Looking for a signal later in the pulse takes this into account. In addition, simply programming the microprocessor to look for a pulse only when LEDs 138 and 139 are activated also reduces errors caused by outdoor use.

A computer routine which may be used with the circuitry of the present invention is as follows:

```
;*************************************************************
;
            _CONFIG _CP_ALL & _WDT_OFF &
        _PWRTE_ON & _INTRC_OSC & _MCLRE_OFF
;
;*************************************************************
;   All of the equates are listed below.
;*************************************************************
;
;Usable Registers: 32 to 127
X_VALUE     EQU     32      ;used in waita routine, a loop delay
Y_VALUE     EQU     33      ;
Z_VALUE     EQU     34      ; . . .
temp1       EQU     35      ;temp register used in 'waita routine
temp2       EQU     36      ;
temp3       EQU     37      ; . . .
                            ;
flag        EQU     38      ;register to tell when to check inputs
input       EQU     39      ;input storage register
;           EQU     40      ;
;           EQU     41      ;
;           EQU     42      ;
;           EQU     43      ,
;           EQU     44      ;
;           EQU     45      ;
;           EQU     46      ;
                            ;
;*************************************************************
;   Start of Program
;*************************************************************
                            ;
        org     0           ;
        goto    config      ;jump around interrupt routine
                            ;
;*************************************************************
;   Interrupt Routine
;*************************************************************
                            ;
        org     4           ;interrupt vectors here
        btfss   INTCON, T0IF ;Check if TMR0 overflow
        goto    int_end     ;NO, so get out of here
        movlw   210         ;otherwise, set TMR0
        movwf   TMR0        ;
        bcf     INTCON, T0IF ;clear the TMR0 interrupt flag
        btfss   GPIO,5      ;Check for Infrared's already on
        goto    interrupt1  ;no, so go turn them on
        bcf     GPIO,5      ;yes, so turn them off
        movf    GPIO,w      ;get the inputs
        movwf   input       ,and save them
        bcf     flag,0      ,clear the "inputs checked" flag
        retfie              ;and leave
interrupt1 bsf  GPIO,5      ;turn on the Infrared's
        retfie              ;and leave
int_end movlw   B'1010000'  ,reset the interrupt control
        movwf   INTCON      ;register and then leave
        retfie              ;
                            ;
;*************************************************************
;   Configure Ports for Analog/Digital Input
;*************************************************************
config  bcf     STATUS, IRP ;register bank select bit for
        bcf     STATUS, RP1 ;indirect addressing
                            ;
        bsf     STATUS, RP0 ;Setect page 1
        call    07FFH       ;Get the osc. cal. value
        movwf   OSCCAL      ;and save it to the cal. location
        movlw   B'00000111' ;select no analog inputs
        movwf   ADCON1      ;configure ports
        bcf     PIE1, ADIE  ;disable A/D interrupts
        clrf    OPTION_REG  ;Set up the option register
        bsf     OPTION_REG,7 ;
                            ;
        bcf     STATUS, RP0 ;select page 0
                            ;
        bsf     INTCON, GIE ;enable interrupt
        bcf     INTCON, PEIE ;disable peripheral interrupts
        bsf     INTCON, T0IE ;enable TMR0 Interrupt
        bcf     INTCON, INTE ;disable external interrupt
        bcf     INTCON, GPIE ;disable GPIO Interrupts
```

-continued

```
        bcf     INTCON, T0IF    ;clear TMR0 interrupt flag
        bcf     INTCON, INTF    ;clear external interrrupt flag
        bcf     INTCON, GPIF    ;clear GPIO interrupt flag
                                ;
;*************************************************************
;   Configure Ports for Output/Input
;*************************************************************
                                ;
        bsf     STATUS, RP0     ;select page 1
                                ;
        movlw   B'00001011'     ;GP0,GP1,GP3 inputs, rest
                                outputs
        movwf   TRISIO          ;set I/O's
                                ;
        bcf     STATUS, RP0     ;select page 0
                                ;
                                ;
;*************************************************************
;   Initialise values
;*************************************************************
                                ;
        movlw   205             ;Set up TMR0 to count 100 uS
                                for
        movwf   TMR0            ;pulses at 5 KHz and 50%
                                duty cycle
        clrf    GPIO            ;
                                ;
        bcf     GPIO, 5         ;turn off IR emitters
        bcf     GPIO, 4         ;left LED on
        bcf     GPIO, 2         ;right LED on
                                ;
        movlw   248             ;set 1 second delay
        movwf   X_VALUE         ;
        movlw   8               ;
        movwf   Y_VALUE         ;
        movlw   167             ;
        movwf   Z_VALUE         ;
        call    waita           ;1 second delay
                                ;
        bsf     GPIO, 4         ;left LED off
        bsf     GPIO, 2         ;right LED off
                                ;
        movlw   246             ;set up for 4 second delay
        movwf   X_VALUE         ;to use later
        movlw   35              ;
        movwf   Y_VALUE         ;
        movlw   77              ;
        movwf   Z_VALUE         ;
                                ;
;*************************************************************
;   The main routine.
;*************************************************************
Main                            ;
        btfsc   GPIO, 5         ;check for Infrared's on
        goto    Main1           ;
        btfsc   flag, 0         ;see if we should check inputs
        goto    Main1           ;no, so get out of here
                                ;
        bsf     flag, 0         ;set the flag so we only do this
                                once
                                ;
Left_led  btfss input, 0        ;check for right input
        goto    Left_off        ;not 'on' so leave here
        bcf     GPIO, 4         ;turn right LED on
        goto    Right_led       ;go check for left side
                                ;
Left_off  bsf   GPIO, 4         ;turn right LED off
                                ;
Right_led btfss input, 1        ;Check for left input
        goto    Right_off       ;not 'on' so leave here
        bcf     GPIO, 2         ;turn left LED on
        goto    Main1           ;go check for impact
                                ;
Right_off bsf   GPIO, 2         ;turn left LED off
                                ;
Main1   btfsc   GPIO, 3         ;check impact sensor, if 1 then
                                delay
        call    waita           ;4 second delay
        Goto    Main            ;loop back to main
```

-continued

```
                                ;
;*************************************************************
; wait_a
;       Function: This routine is a delay loop. The delay
;       is set by the equates Z1_VALUE, Y1_VALUE, and
        X1_VALUE.
;
;       The time delay can be calculated using the formula
;       below where X, Y, and Z have been used as a shorthand:
;
;       Delay = (4 + (Z − 1) * 3) + [(4 + (Y − 1) * 3) +
        (4 + (X − 1) * 3) * Y] * Z
;
;       The retlw adds another 2 clock cycles and calling this
;       routine takes 2 cycles to transfer control. Therefore,
;       the total time delay generated by 'call wait_a' is
;       equal to Delay + 4 and is given below:
;       TOTAL DELAY = 4 + (4 + (Z − 1) * 3) +
        [(4 + (Y − 1) * 3) + (4 + (X − 1) * 3) * Y) * Z
;       Example: Z:52, Y:101, X:5 ==> 100,001 clock cycles
        ;
;*************************************************************
waita                           ;
        movf    Z_VALUE, w      ;
        movwf   temp3           ;
wait_a_3 movf   Y_VALUE, w      ;
        movwf   temp2           ;
wait_a_2 movf   X_VALUE, w      ;
        movwf   temp1           ;
wait_a_1 decfsz temp1, F        ;
        goto    wait_a_1        ;
        decfsz  temp2, F        ;
        goto    wait_a_2        ;
        decfsz  temp3, F        ;
        goto    wait_a_3        ;
        return                  ;
                                ;
        END
```

In use, the club face or impact surface is positioned behind a ball or other object to be struck 22. To determine if the club face or impact surface is properly aligned, infrared is pulsed from LEDs 138 and 139. The infrared reflects off of ball 22 and is received by sensors 128 and 129. If microprocessor 10 receives signals from both sensors 128 and 129, LEDs 154 and 155 will be activated as shown in FIG. 4. This indicates proper alignment. For the embodiment involving a golf club, this will be typical when the ball is positioned at the sweet spot of the club. Misalignment will result in only one of the sensors receiving infrared as shown in FIG. 5. This will only result in either LED 154 or 155 being activated which, depending on the LED activated, indicates either an open or closed club face.

To be truly useful, the club must also be capable of being swung through a complete stroke while retaining the ability to inform the user of the orientation of the club face or impact surface at the time of impact. As mentioned above, this is not possible in current designs. For example, as described above, with respect to a golf club embodiment, once the golf ball is struck, the source for reflecting the infrared back to the sensors is no longer present which results in the indicators being turned off. To take this into account, once the microprocessor receives a signal from sounder 300, the information that is currently being received by the microprocessor 10 as to the orientation of the club face is frozen and held for a predetermined amount of time. This allows a user to perform a take-away and then complete a full swing, which often results in the club being positioned at the user's back upon completion. To review the stroke, the user must unwind and only then can the results be examined. Moreover, the golfer typically does not see the indicators at the time of impact since the golfer's focus is on swinging the club even for the slower speed putting strokes. This is also especially true for swings using other clubs such as irons, woods and drivers, baseball bats, hockey sticks and tennis rackets, which may reach speeds up to 100 mph, or more. Freezing the information obtained in the manner described above creates a useful training aid.

While the preferred embodiments of the present invention have been illustrated and described, it will be understood by those of ordinary skill in the art that changes and other modifications can be made without departing from the invention in its broader aspects. Various features of the present invention are set forth in the following claims.

What is claimed is:

1. A golf club for impacting a golf ball comprising:

a club head having a club face with a plurality of infrared sources, a plurality of infrared sensors, and indicators configurable to indicate club face alignment wherein said infrared sources are pulsed at a rate of 2–6 kilohertz;

said sensors configured on said club head to receive infrared signals from said infrared sources and to transmit signals in response to said infrared signals received;

a filter means for blocking direct current signals transmitted by said infrared sensors; and processing means for receiving the filtered signals from said infrared sensors, for determining the club face alignment based upon the filtered signals received;

and for activating said indicators to indicate said club face alignment.

2. The device of claim 1 wherein said sporting apparatus is a golf club comprising a putter, wood, driver or iron.

3. The golf club of claim 1 wherein said processing means is a microprocessor.

4. The golf club of claim 1 further including an impact sensor for generating a signal received by said microprocessor indicating club head impact.

5. The golf club of claim 1 wherein said filter means is a capacitor.

6. The golf club of claim 1 wherein said infrared sources are pulsed at a rate of 4 kilohertz.

7. The golf club of claim 1 wherein said infrared sources are supplied additional power by a capacitor in communication with said infrared sources.

8. A golf club for impacting a golf ball comprising:

a club head having a club face with a plurality of infrared sources, a plurality of infrared sensors, and indicators to indicate club face alignment;

said infrared sources pulsed at a rate of 4 kilohertz;

said sensors configured on said club head to receive pulsed infrared signals from said infrared sources and to transmit signals in response to said pulsed infrared signals received;

filter means for blocking direct current signals transmitted by said infrared sensors;

processing means for receiving the filtered signals transmitted from said infrared sensors, for determining club face alignment and for activating said indicators to indicate said club face alignment.

9. The golf club of claim 8 wherein said filter means is a capacitor.

10. The golf club of claim 8 wherein said processing means is a microprocessor.

11. A golf club for impacting a golf ball comprising:

a club head having a club face with a plurality of infrared sources, a plurality of infrared sensors, and indicators configurable to indicate club face alignment;

said infrared sources pulsed at a rate of between 2–6 kilohertz;

said sensors configured on said club head to receive pulsed infrared signals from said infrared sources and to transmit signals in response to said pulsed infrared signals received;

filter means for blocking direct current signals transmitted by said infrared sensors;

processing means for receiving the filtered signals transmitted from said infrared sensors, for determining club face alignment, and for activating said indicators to indicate said club face alignment.

12. The golf club of claim 11 wherein said filter means is a capacitor.

13. The golf club of claim 11 wherein said processing means is a microprocessor.

* * * * *